US006719145B1

(12) United States Patent
Härkönen et al.

(10) Patent No.: US 6,719,145 B1
(45) Date of Patent: Apr. 13, 2004

(54) ARRANGEMENT AND ROTOR FOR SCREENING OF PULP

(75) Inventors: Pasi Härkönen, Savonlinna (FI); Raimo Kohonen, Savonlinna (FI); Pekka Karppinen, Karhula (FI); Ari Pelkiö, Savonlinna (FI); Kader Rahkonen, Kotka (FI); Riitta Rahkonen, Kotka (FI)

(73) Assignee: Andritz Oy, Helsinki (FI)

( * ) Notice: Subject to any disclaimer, the term of this patent is extended or adjusted under 35 U.S.C. 154(b) by 0 days.

(21) Appl. No.: 10/130,058

(22) PCT Filed: Nov. 22, 2000

(86) PCT No.: PCT/FI00/01014

§ 371 (c)(1),
(2), (4) Date: May 15, 2002

(87) PCT Pub. No.: WO01/40570

PCT Pub. Date: Jun. 1, 2001

(30) Foreign Application Priority Data

Nov. 29, 1999 (FI) ..... 990488 U

(51) Int. Cl.[7] ..... B07B 1/52

(52) U.S. Cl. ..... 209/389; 209/380; 209/270; 209/296

(58) Field of Search ..... 209/389, 380, 209/270, 280, 296, 297

(56) References Cited

U.S. PATENT DOCUMENTS 2,796,809 A * 6/1957 Sprau ..... 209/273
3,637,077 A * 1/1972 Cowan ..... 209/273
3,713,536 A * 1/1973 Hooper ..... 209/273
4,234,417 A 11/1980 Gauld et al.
4,267,035 A * 5/1981 Martin ..... 209/273
4,374,728 A * 2/1983 Gauld ..... 209/273
4,754,935 A * 7/1988 Gullichsen ..... 241/19
5,000,842 A 3/1991 Ljokkoi
5,224,603 A 7/1993 Hanana et al.
5,547,083 A 8/1996 Alajääski et al.
5,601,690 A * 2/1997 Gauld et al. ..... 162/55

FOREIGN PATENT DOCUMENTS

| | | |
|---|---|---|
| CA | 1007576 | 3/1929 |
| CA | 1335191 | 4/1995 |
| WO | 93/23609 | 11/1993 |

* cited by examiner

*Primary Examiner*—Donald P. Walsh
*Assistant Examiner*—Jonathan R Miller
(74) *Attorney, Agent, or Firm*—Nixon & Vanderhye, P.C.

(57) ABSTRACT

An arrangement and a rotor for screening of pulp is disclosed that is suitable for the screening of chemical and mechanical pulps, i.e. fiber suspensions of the wood processing industry. A feature of the arrangement and rotor is that inside the rotor (16) there is arranged at least one dilution liquid chamber (24', 24", 24'") restricted by a surface of the rotor (16), which surface is provided with means for connecting said at least one chamber (24', 24", 24'") with the screening space defined between the rotor and the screen drum in such a way that dilution liquid from said at least one chamber (24', 24", 24'") is brought into the screening space at a distance of at least 20 mm from the inner surface of the screen drum (14).

24 Claims, 1 Drawing Sheet

ARRANGEMENT AND ROTOR FOR SCREENING OF PULP

BACKGROUND AND SUMMARY OF INVENTION

The present invention relates to an arrangement and a rotor for screening of pulp. The arrangement and rotor according to the invention are especially suitable for the screening of chemical and mechanical pulps, i.e. fiber suspensions of the wood processing industry.

This application claims priority to international patent application PCT/F100/01014 filed Nov. 22, 2000, and to Finnish application U990488 filed Nov. 29, 1999.

Naturally, prior art knows several devices used for screening fiber suspension. Reference is here made to solutions according to U.S. Pat. Nos. 5,000,842, 5,224,603 and 5,547,083 which are meant for screening fiber suspensions at a relatively high consistency, which in the field of screening means a consistency of about 2.5–5%. Said consistency is so high, that in order to maintain the screenability of the pulp, special characteristics and construction are required from the pulsation member, i.e. the rotor, to prevent the pulp from forming excessively large and strong fiber accumulations in the screening area. E. g., in the above patents the rotor is essentially cylindrical and on the surface of the cylinder there are so-called bulges arranged according to a certain configuration for maintaining the turbulence level and pulsation of the suspension.

During the years, the screen comprising said rotor has proved to be a reliable and advantageous apparatus, but in some situations the consistency of the suspension in the screening area between the screen drum and the rotor tends to rise so high that said bulges are not capable of increasing the turbulence level high enough to maintain optimum screening efficiency. One solution for the problem is to apply dilution of the suspension in the screening area.

Accordingly, prior art knows several various solutions for diluting the pulp between the cylindrical rotor and the also cylindrical screen drum. As an example of these solutions e.g. U.S. Pat. No. 4,234,417 may be mentioned, in which the surface of the rotor cylinder is provided with blades extending to the whole height of the rotor. On the trailing side of these blades, when looking in the rotating direction of the rotor, there are outlet ports via which dilution liquid is fed in the suspension. Said outlet ports lead inside the rotor, where there are three annular chambers arranged one upon the other so that dilution liquid is fed into each chamber from outside the screen.

Said construction has both advantages and disadvantages. The only advantage worth mentioning is that the dilution liquid is fed specifically via the rotor, whereby it would not be necessary to guide it near to the screening surface. Nevertheless, when performing according to the patent, i.e. when bringing the dilution liquid via the blades of the rotor onto the back surface of the blades, to the area of intense suction, there is a great risk that the dilution liquid is passed onto the screening surface and therethrough quickly further to the accept side without actually diluting the pulp in the screening area. A second disadvantage worth mentioning is the complexity of the construction, as e.g. making the hole of FIG. 5 requires two opposite drillings in the blade and additionally one drilling in the surface of the rotor cylinder.

CA patent 1007576 discloses an another example of a rotary pulp screening device in which dilution water is directed against the screen. There is provided a rotary pulp screening apparatus including a housing with a stock inlet chamber, stock screening chamber, a cylindrical screen and a rotor in the form of a truncated cone having an upper portion and a lower portion. The improvement comprises a circumferential dividing ring extending around the wall of the lower portion of the cone, means for fastening the ring to the wall of the lower portion and a plurality of dilution water nozzle's positioned in the lower portion adapted to direct water against the screen. The dividing ring may be moved up or down the lower portion of the rotor, or it may be welded in a predeterminated position. The dividing ring generally permits the effect of the dilution water to be localized in one area because it stops the water from rising upwards. The impeller rotor, being in the form of a truncated cone, may be provided with a series of blades or with foils, whereas the present invention relates to an essentially cylindrical rotor with turbulence-generating members such as so-called bulges.

Said problems have been solved by the arrangement and rotor according to the present invention, the characteristic features of which are disclosed in the appended claims.

SUMMARY OF DRAWINGS

In the following, the invention is disclosed in more detail with reference to the appended figures, of which

DETAILED DESCRIPTION OF INVENTION

The invention relates to a screen, preferably a pressure screen, comprising an essentially cylindrical outer casing with its end, a stationary essentially cylindrical screen drum (although in some circumstances a conical screen drum is also used) arranged inside it, which leaves between itself and said casing a so-called accept space. Inside the screen is drum, there is a rotor arranged at the shaft led via the other end, which rotor is provided with members for creating pressure impulses required for the screening in the annular so-called screening space between the screen drum and the rotor. The outer casing of the screen is further provided with at least three conduits. A feeding conduit communicates with the screening space and when the screen has been positioned to a vertical position said conduit is arranged at the upper end of the screen casing. An accept discharge conduit is arranged on the outer casing of the screen and communicates with the accept space. And a third conduit is a reject conduit, which communicates with the screening space, from the direction of the feeding conduit with the opposite end thereof. In some cases there is further an apparatus for separating so-called heavy or coarse reject are ranged at the upper end of the screen above the screen drum.

Figure 1:
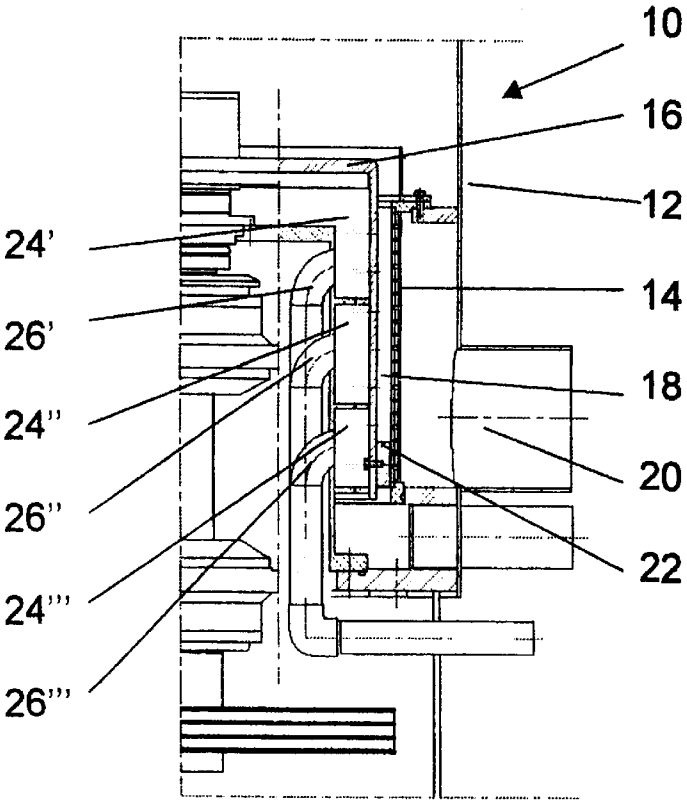
FIG. 1 illustrates an arrangement according to a preferred embodiment of the invention in side projection from the direction of the screen axis.

The screen 10 according to FIG. 1 comprises in this embodiment primarily the components described above, of which e.g. the following may be mentioned here: an essentially cylindrical casing 12, inside of which there is arranged an essentially cylindrical screen drum 14 attached to the casing, inside of which drum there is a rotating essentially cylindrical rotor 16. From the screening space 18, more specifically from the lower end thereof, between the outer casing 12 and the screen drum 14, a so-called accept conduit 20 leads out of the screen. The outer surface of the rotor 16 is provided with pulsation members located at certain intervals, e.g. so-called bulges 22, which are described e.g. in U.S. Pat. No. 5,000,842. According to a preferred embodiment of the invention illustrated in this figure, there is/are at least one, preferably three annular chambers 24', 24" and 24'" arranged inside the rotor 16. Dilution liquid is fed into these by means of at least one, preferably three tubes 26', 26", 26'" from outside the screen 10. Preferably there are regulation valves (not shown) arranged in connection with said tubes 26', 26", 26'", by means of which valves the pressure/amount of liquid flowing in the tubes may be regulated if desired. At the location of the chambers 24', 24", 24'", the surface of the rotor is perforated so that dilution liquid from the chambers is allowed to flow through the rotor casing. Said chambers 24', 24" and 24'" extend preferably to at least 50% of the whole length of the rotor, preferably to at least 70% of the length of the rotor. Preferably the lowest chamber 24'" is located in the vicinity of the lower edge of the rotor so that liquid being fed from the chamber into the screening space dilutes the pulp in the space throughout the whole screen drum 14 and the lower edges of the rotor 16.

Figure 2:
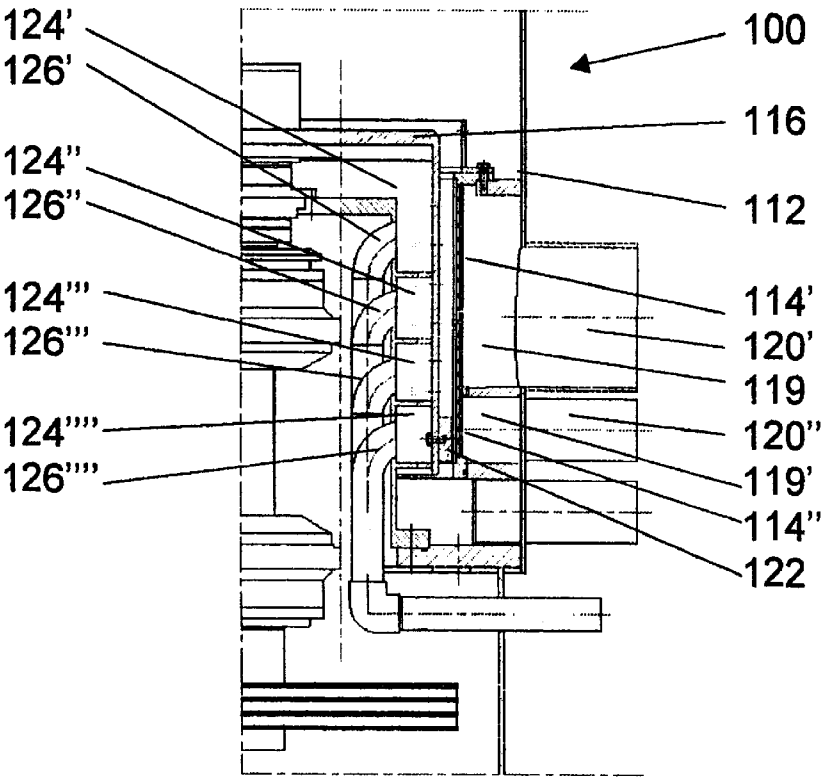
FIG. 2 illustrates an arrangement according to a second preferred embodiment of the invention in side projection from the direction of the screen axis.

FIG. 2 illustrates a screen 100 according to another preferred embodiment of the invention, which screen differs from that of FIG. 1 in that said screen 100 has two screening zones with two accept spaces 119 and 119' and two screen drums 114' and 114". Of course, it is possible to arrange the apparatus to operate with one screen drum only, whereby the type of perforation of the lower part of the screen drum 114" located at the second accept space is preferably different from that of the upper part of the drum 114'. The embodiment of the figure has naturally also two accept discharge conduits, conduits 120' and 120", one from each accept space 119 and 119'. A further characteristic feature of the invention of this embodiment is that the rotor 116 is further provided with still one dilution liquid chamber 124"" located opposite the second accept space 119'. The idea of the solution according to this embodiment is that among the reject i.e. the fiber suspension still present in the screening area after screening in the first screening stage, the upper one in the figure, possibly performed at a relatively high consistency, there still is acceptable fiber fraction that might be separated from the suspension in preferable conditions. These conditions may be created so that dilution liquid is fed amply from the lower dilution liquid chamber into the screening space, whereby the consistency of the fiber suspension in the screening space decreases very low, which in turn ensures that all acceptable fiber material is "washed" from the suspension. This way minimizing the reject amount may maximize the efficiency of the apparatus.

What makes the arrangement according to the present invention superior to prior art solutions is that the dilution liquid is led onto the cylindrical rotor as far away from the screen drum as possible, whereby the risk of the dilution liquid passing quickly into the accept is minimized. However, it is clear that the dilution liquid is efficiently mixed in the fiber suspension, as the continuously operating turbulence-generating elements in the space between the rotor and the screen drum maintain continuous turbulence in the screening space.

In our experiments we have noticed that by bringing the dilution liquid to a distance of at least about 20 mm, though preferably at least 25 mm from the screening surface, the dilution of the accept may be minimized, while the consistency of the fiber suspension in the screening space may be maintained during the whole screening operation essentially the same as the consistency of the untreated fiber suspension being fed into the apparatus. Further our experiments attested our fear, i.e. that if the dilution liquid is brought nearer to the screening surface, the dilution of the accept initiates and the consistency of the suspension in the screening space increases, whereby part of the usable fiber material inevitably remains in the reject.

Additionally our experiments showed that the turbulence-generating elements on the surface of the rotor should preferably be, if not exactly similar to the ones described in U.S. Pat. No. 5,000,842, at least relatively closely resembling them. That is, the turbulence generating elements shall most preferably be angular and in many cases plow-like in order to both generate an intense turbulence in the fiber suspension and guide the movement of the suspension in the screening space to a desired direction.

As noticed from the above, a new way of treating pulp in connection with screening has been developed, in which way the consistency of the pulp in the screening space between the rotor and the screen drum remains essentially the same during the whole screening operation. What has been presented in the above, is to be understood as just some preferable examples of the invention, from which the invention may differ in many relations within the scope of the appended claims. Thus, it is completely possible that inside the rotor there are not only one or three but e.g. two or four, or even more, dilution liquid chambers. The number of the chambers is completely dependent on the object of application of the rotor. Accordingly, it is totally possible and in some cases even recommendable that the walls between the chambers are not completely impermeable, but between them may be arranged some kind of e.g. throttled flow connection. Further it is possible to lead dilution liquid into all chambers via one and the same inlet tube and to regulate the flow of the liquid into the screening space by changing the size of the flow openings in the longitudinal direction of the rotor. Further it is naturally clear that the screen may be positioned in another position than the vertical position presented in the above description.

We claim:

1. A screen assembly for pulp fibers comprising:

an outer casing;

at least one stationary cylindrical screen drum arranged inside the outer casing;

a rotating cylindrical rotor arranged inside the screen drum and having a cylindrical rotor outer surface, wherein turbulence-generating members are attached to the rotor outer surface;

a screening space defined between the cylindrical rotor outer surface and an inner surface of the screen drum, and at least one dilution liquid chamber restricted by an inside surface of the rotor, wherein dilution liquid from said at least one dilution liquid chamber flows through the rotor and is discharged from said cylindrical rotor outer surface directly into the screening space, wherein said discharge from the cylindrical rotor outer surface is at a distance of at least 20 millimeters (mm) from the inner surface of the screen drum.

2. A screen assembly as in claim 1 wherein at least one tube provides dilution liquid to said at least one dilution liquid chamber.

3. A screen assembly as in claim 2 wherein said tube includes a valve for regulating the dilution liquid flow.

4. A screen assembly as in claim 1 wherein a flow connection is arranged between a plurality of chambers.

5. A screen assembly comprising:

an outer casing;

at least one stationary cylindrical screen drum arranged inside the outer casing;

a rotating cylindrical rotor arranged inside the screen drum and having a cylindrical rotor outer surface, wherein turbulence-generating members are attached to the rotor outer surface and said rotor is perforated to provide flow passages from an inside surface of the rotor to the cylindrical rotor outer surface;

a screening space defined between the cylindrical rotor surface and an inner surface of the screen drum, and at least one dilution liquid chamber restricted by the inside surface of the rotor wherein dilution liquid from said at least one dilution liquid chamber flows through the perforated cylindrical rotor surface directly into the screening space, wherein said discharge from the cylindrical rotor outer surface is at a distance of at least 20 millimeters (mm) from the inner surface of the screen drum.

6. A screen assembly as in claim 5 wherein the rotor surface is perforated along at least half of a length of a portion of the rotor surface restricting the dilution liquid chamber.

7. A screen assembly as in claim 5 wherein the rotor is perforated along at least seventy percent of a length of a portion of the rotor restricting the dilution liquid chamber.

8. A screen assembly as in claim 5 wherein the rotor is perforated starting at a lower edge of the rotor adjacent the at least one dilution liquid chamber.

9. A screen assembly as in claim 1 wherein the screen assembly is provided with first and second screening zones, and each of said first and second screening zones corresponds to separate screen drums or segments of the screen drum, whereby said at least one dilution liquid chamber is situated at the second screening zones.

10. A screen assembly as in claim 1 wherein a dilution liquid connection is provided by openings made in a casing of the rotor, which openings open to an outer surface of the rotor.

11. A rotor for a screen assembly to screen pulp comprising:

a cylindrical rotor having an outer surface on which is mounted turbulence-generating members, wherein the outer surface is circular in cross-section;

at least one dilution liquid chamber inside and adjacent an interior surface of said rotor;

the interior surface of the rotor forming one side of the at least one dilution liquid chamber, and said rotor having flow conduits between the interior and outer surfaces for dilution liquid flowing from the at least one dilution liquid chamber through the rotor to the outer surface, wherein said outer surface is positioned at a distance of at least 20 millimeters (mm) from the inner surface of a screen drum.

12. A rotor as in claim 11 further comprising a tube for dilution liquid flowing into the at least one dilution liquid chamber.

13. A rotor as in claim 12 further comprising a valve for regulating a flow of the dilution liquid through said tube.

14. A rotor as in claim 11 further comprising a flow connection arranged between a plurality of chambers of said at least one dilution liquid chamber.

15. A rotor as in claim 11 wherein the conduits are perforations through the surfaces of the rotor and said conduits have discharge openings on said outer surface of the rotor.

16. A rotor as in claim 15 wherein the rotor interior surface is adjacent the at least one dilution liquid chamber, and said rotor is perforated along at least one-half of a length of a portion of the rotor adjacent the chamber.

17. A rotor as in claim 15 wherein the interior surface has perforations along at least seventy percent of a length of the rotor adjacent the at least one dilution liquid chamber.

18. A rotor as in claim 15 wherein the interior surface has perforations beginning from a lower edge of the rotor adjacent the at least one dilution liquid chamber.

19. A screen assembly for pulp fibers comprising:

an outer casing;

at least one stationary screen drum arranged inside the outer casing;

a rotating rotor arranged inside the screen drum and having a inside rotor surface and an outside rotor surface, wherein said rotor is porous between said inside rotor surface and said outside rotor surface, and said outside rotor surface is circular in cross-section;

a screening space defined between the outside rotor surface and the screen drum, wherein a distance of at least 20 millimeters (mm) exists between the outer rotor surface and an inner surface of the screen drum, and;

at least one dilution liquid chamber is arranged within the rotor and having the inside rotor surface as an outer chamber wall and an inlet for dilution liquid opposite to the chamber wall, wherein dilution liquid flows through said porous rotor and is discharged from the outside rotor surface directly into said screening space.

20. A screen assembly as in claim 19 wherein the screen drum is cylindrical.

21. A screen assembly as in claim 19 wherein the screen drum is conical.

22. A screen assembly as in claim 19 wherein said outside rotor surface has mounted thereon bulges to induce turbulence in a flow of pulp fibers through the screening space.

23. A screen assembly as in claim 19 wherein the at least one dilution chamber extends a length of at least one-half of a length of the rotor.

24. A screen assembly as in claim 19 wherein the at least one dilution chamber extends a length of at least seventy percent of a length of the rotor.

* * * * *